US008512632B2

(12) United States Patent
Tamiya et al.

(10) Patent No.: US 8,512,632 B2
(45) Date of Patent: Aug. 20, 2013

(54) MANUFACTURING METHOD OF CONTACT LENS PACKAGE

(75) Inventors: Yuka Tamiya, Nagoya (JP); Takashi Yamamoto, Kitanagoya (JP)

(73) Assignee: Menicon Co., Ltd., Nagoya (JP)

( * ) Notice: Subject to any disclaimer, the term of this patent is extended or adjusted under 35 U.S.C. 154(b) by 0 days.

(21) Appl. No.: 13/513,016

(22) PCT Filed: Dec. 8, 2009

(86) PCT No.: PCT/JP2009/006703

§ 371 (c)(1),
(2), (4) Date: May 31, 2012

(87) PCT Pub. No.: WO2011/070612

PCT Pub. Date: Jun. 16, 2011

(65) Prior Publication Data

US 2012/0234702 A1 Sep. 20, 2012

(51) Int. Cl.
*A61L 2/08* (2006.01)
*B65B 55/02* (2006.01)

(52) U.S. Cl.
USPC ..... 422/26; 53/425

(58) Field of Classification Search
USPC ..... 422/26; 53/425
See application file for complete search history.

(56) References Cited

U.S. PATENT DOCUMENTS

| | | | |
|---|---|---|---|
| 6,156,244 | A | 12/2000 | Müller et al. |
| 6,634,748 | B1 | 10/2003 | Vanderlaan et al. |
| 2005/0196370 | A1 | 9/2005 | Yu et al. |
| 2007/0149428 | A1 | 6/2007 | Ammon, Jr. et al. |
| 2009/0059165 | A1 | 3/2009 | Pruitt et al. |

FOREIGN PATENT DOCUMENTS

| | | |
|---|---|---|
| EP | 2 103 552 A1 | 9/2009 |
| JP | A-2000-513665 | 10/2000 |
| JP | A-2004-517163 | 6/2004 |
| JP | A-2009-520219 | 5/2009 |
| JP | A-2009-175543 | 8/2009 |
| WO | WO 2005/071467 A1 | 8/2005 |

OTHER PUBLICATIONS

Jul. 19, 2012 International Preliminary Report on Patentability cited in International application No. PCT/JP2009/006703, filed Dec. 8, 2009.
International Search Report issued in International Application No. PCT/JP2009/006703 dated Feb. 16, 2010.
Mar. 25, 2013 Extended European Search Report for European Patent Application No. 09852009.1.

*Primary Examiner* — Kevin Joyner
(74) *Attorney, Agent, or Firm* — Oliff & Berridge, PLC

(57) ABSTRACT

A novel contact lens package containing a silicone hydrogel soft contact lens, which can be offered to the market in a hermetically sealed preserved state with excellent shape stability (dimensional stability). Also provided is a manufacturing method of the same. The novel contact lens package is manufactured by using a silicone hydrogel contact lens as a soft contact lens, sealing both a storage solution so as to contain a phosphoric acid and the silicone hydrogel contact lens in a housing area of a contact lens package, and then performing high pressure steam sterilization processing.

6 Claims, 4 Drawing Sheets

MANUFACTURING METHOD OF CONTACT LENS PACKAGE

TECHNICAL FIELD

The present invention relates to a contact lens package which houses contact lenses and a storage solution in a hermetically sealed state, and the manufacturing method thereof. It also relates to a method for stabilizing silicone hydrogel molded products such as contact lenses or the like.

BACKGROUND ART

In recent years, silicone hydrogel has been proposed as a material for contact lenses. Silicone hydrogel is excellent in terms of oxygen permeability compared to the hydrogel of the prior art, so it is being studied for use with soft contact lenses.

Soft contact lenses are provided to users in a state immersed in a storage solution, sealed in the contact lens package, and shipped to the market. At that time, the time from when the contact lens package is provided to the market by the manufacturer until the lenses are worn by the user can take a long time, from several weeks to several years. Over such a long time, the soft contact lenses need to have stable preservation of their physical properties and shape. In particular, it is necessary not only to satisfy the product specifications, but also to maintain high precision since changes in shape bring changes in the wearing comfort or optical characteristics for the user. In light of that, methods for storing soft contact lenses include for example the methods noted in Patent Document 1 (Japanese National Phase of PCT Application Publication No. JP-A-2004-517163) and Patent Document 2 (Japanese National Phase of PCT Application Publication No. JP-A-2000-513665).

However, upon checking by the inventors, with silicone hydrogel soft contact lenses, the inventors found that it is difficult to sufficiently ensure the dimensional precision of the lens diameter (DIA) and the like. For this dimensional precision problem, initially efforts were made to improve the molding precision, but it was difficult to obtain satisfactory results with that. In light of that, upon further examination by the inventors, it was newly discovered that this is a problem specific to silicone hydrogel soft contact lenses, and that the lens shape (dimension) changes under hermitically sealed storage conditions after the contact lenses are manufactured.

BACKGROUND ART DOCUMENTS

Patent Documents

Patent Document 1: JP-A-2004-517163
Patent Document 2: JP-A-2000-513665

SUMMARY OF THE INVENTION

Problem the Invention Attempts to Solve

The present invention has been developed with the circumstances described above as the background, and an objective is to provide a novel contact lens package and the manufacturing method thereof which makes it possible to provide soft contact lenses made of silicone hydrogel to the market in a hermetically sealed preserved state with excellent shape stability (dimensional stability).

A further objective of the present invention is to provide a novel method that is able to stabilize silicone hydrogel molded products such as contact lenses or the like, and to provide excellent shape stability.

Means for Solving the Problem

Following are modes of the present invention for addressing the problems as described above. Note that the constitutional elements used for each mode noted below are able to be used in any desired combination to the extent possible.

Specifically, a first mode of the present invention relating to the manufacturing method of a contact lens package is a manufacturing method of a contact lens package in which a soft contact lens and a storage solution are hermetically sealed in a housing area, being characterized by comprising the following steps: preparing a silicone hydrogel contact lens as the soft contact lens; preparing the storage solution so as to contain a phosphoric acid; and sealing the silicone hydrogel contact lens together with the storage solution containing the phosphoric acid in the housing area, and performing high pressure steam sterilization processing.

If the contact lens package is manufactured according to this mode, even when there is a long storage period after high pressure steam sterilization processing (autoclaving), it is possible to prevent an increase in the diameter (DIA) or the like of the contact lens or lenses sealed inside, and to keep the contact lens shape constant. As a result, it is possible to suppress the phenomena of optical characteristic changes or decrease in wearing comfort or the like due to changes in shape or changes in dimension of the contact lenses over time after high pressure steam sterilization with silicone hydrogel contact lenses.

By performing high pressure steam sterilization processing with the silicone hydrogel contact lenses in a state immersed in a storage solution containing a phosphoric acid, the shape stability (dimensional stability) of the silicone hydrogel contact lenses becomes better after that. It is not clear why the shape stability is improved, but it is assumed that the shape change (e. g. diameter expansion) of silicone hydrogel contact lenses, which conventionally gradually progressed after high pressure steam sterilization processing, arose in a very short time with high pressure steam sterilization processing in the presence of a phosphoric acid. This makes it possible to prevent the shape change of contact lenses after shipping that occurred after high pressure steam sterilization processing conventionally, and even when a long time elapses from when the contact lens package is provided to the market until it is used by the user, it became possible to stably keep the shape at the time the contact lens was shipped.

Contact lenses typically have several specifications, in addition to the lens diameter (DIA), such as various lens dimensions such as the optical power (power), base curve shape (BC) and the like, which are very strictly determined in order to provide lenses that suitably match the variation in visual acuity and cornea shape of each user. In accordance with the present invention, by the shape and dimensions of the silicone hydrogel contact lenses after shipping being kept well over a long time, it is possible to prevent the lens power and various dimension values from deviating from the numerical values of the allowed range determined in the contact lens product specifications that accompany shape changes after shipping. In specific terms, for example, when the lens diameter (DIA) is a 14.00 mm lens standard, the allowed deviation is a very narrow at ±0.20mm. With the contact lens package manufactured according to the method of the present invention, even after 9 months elapse after storage start, the lens diameter (DIA) only changes by approximately ±0.05 mm, so it is possible to sufficiently satisfy the standards.

The second mode of the present invention relating to the manufacturing method of a contact lens package is the manufacturing method of a contact lens package according to the first mode, wherein a phosphoric-acid-concentration in the storage solution is 0.01 to 1.0 weight %.

With this mode, it is possible to effectively exhibit a shape stabilization effect of the silicone hydrogel contact lenses after high pressure steam sterilization processing. Note that when the phosphoric-acid-concentration is lower than 0.01 weight %, it is difficult to sufficiently achieve the shape stabilization after high pressure steam sterilization processing by the phosphoric acid. On the other hand, when the phosphoric-acid-concentration is greater than 1.0 weight %, there is the risk that the user will sense irritation or the like in the eye when wearing the contact lenses.

The third mode of the present invention relating to the manufacturing method of a contact lens package is the manufacturing method of a contact lens package according to the first mode or the second mode, wherein a pH of the storage solution is 7.2 to 8.

With the manufacturing method according to this mode, it is possible to sufficiently exhibit the shape stabilization effect of the phosphoric acid, and to stably store silicone hydrogel contact lenses for a long time. Also, since it is possible to suppress the degradation of the silicone hydrogel due to high pressure steam sterilization processing, it is also possible to maintain the strength of the contact lenses well.

Also, a first mode of the present invention relating to a contact lens package is a contact lens package in which a soft contact lens and a storage solution are hermetically sealed in a housing area, characterized in that a silicone hydrogel contact lens is used as the soft contact lens, and the storage solution is constituted containing a phosphoric acid, while the silicone hydrogel contact lenses are sealed together with the storage solution containing the phosphoric acid in the housing area and subjected to high pressure steam sterilization processing.

With this mode, even if the storage period is a long time after shipping, it is possible to keep the shape of the silicone hydrogel contact lenses inside the contact lens package stable.

With the second mode of the present invention relating to the contact lens package, a fluid volume of the storage solution is 0.15 to 4 mL.

With this mode, by ensuring a sufficient fluid volume of the storage solution within the housing area, it is possible to effectively exhibit the shape stabilization effect by a phosphoric acid.

Also, a first mode of the present invention relating to a method for stabilizing silicone hydrogel molded products is a method of stabilizing a silicone hydrogel molded product hermetically sealed together with a storage solution inside a package, characterized by comprising the following steps: preparing the storage solution so as to contain a phosphoric acid; sealing the silicone hydrogel molded product together with the storage solution containing the phosphoric acid inside the package; and performing high pressure steam sterilization processing.

With this mode, it is possible to stably store molded products consisting of silicone hydrogel for a long time. Specifically, it is possible to prevent silicone hydrogel molded product dimension changes and shape changes, and also to suppress a decrease in strength or the like.

Effect of the Invention

With the present invention relating to the manufacturing method of a contact lens package, by performing high pressure steam sterilization processing with the silicone hydrogel contact lenses in a state immersed in a storage solution containing a phosphoric acid, it is possible to prevent shape or lens dimension changes of the silicone hydrogel contact lenses after high pressure steam sterilization processing. As a result, after shipping, even if a long time elapses until the contact lenses are used by the user, it is possible to stably keep the shape of the contact lens at the time of shipping, making it possible to exhibit good wearing comfort and visibility.

Also, with the present invention relating to the contact lens package, it is possible to keep the shape of the contact lens inside the contact lens package constant over a long time, making it possible to provide contact lenses to the user while maintaining the initial shape to a high quality.

Furthermore, with the present invention relating to the method of stabilizing silicone hydrogel molded products, it is possible to stably store the silicone hydrogel molded products housed inside the package.

EMBODIMENTS FOR CARRYING OUT THE INVENTION

Following, there will be describe one embodiment of these inventions to more specifically clarify the present invention relating to a contact lens package and the manufacturing method thereof, as well as a method for stabilizing silicone hydrogel molded products.

Figure 1:
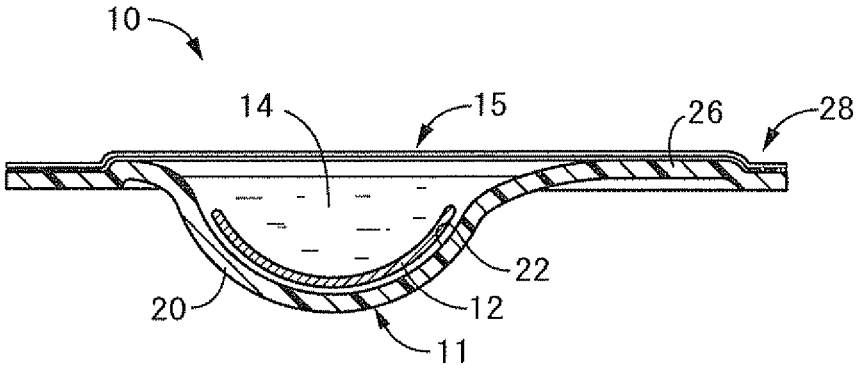
FIG. 1 is an explanatory view showing a specific example of a contact lens package manufactured according to one embodiment of the present invention relating to the manufacturing method of a contact lens package.

First, FIG. 1 shows an example of a contact lens package 10 manufactured according to an embodiment of the present invention relating to the manufacturing method of a contact lens package. Specifically, with this embodiment, the contact lens 12 and the storage solution 14 are housed in the package main unit 11, and after this package main unit 11 is hermetically sealed using a package lid unit 15, by implementing high pressure steam sterilization processing on this, the contact lens package 10 is manufactured, and is shipped to the market.

More specifically, the contact lens 12 of this embodiment is a water-containing soft contact lens, and is a silicone hydrogel contact lens consisting of silicone hydrogel.

Note that as a specific material for this contact lens 12, it is possible to use any of the well known silicone hydrogels, and this is not particularly limited. In specific terms, for example, it is possible to use a polymer or the like including a silicone monomer copolymerized with a hydrophilic monomer. Also, as a material for producing this kind of silicone hydrogel, examples include acquafilcon A, asmofilcon A, balafilcon A, comfilcon A, enfilcon A, galyfilcon A, lenefilcon A, lotorafilcon A, lotorafilcon B, senofilcon A and the like.

As representative silicone monomers that can be contained in a silicone hydrogel, well known items can be used without particular limitations, but as specific examples, we can list, for example, 3-methacryloxy propyl tris(trimethylsiloxy)silane (TRIS), mono methacryloxy propyl terminated polydimethyl siloxane (mPDMS), polydimethyl siloxane, 3-methacryloxy propyl bis(trimethylsiloxy)methyl silane, methacryloxy propyl pentamethyl disiloxane and the like.

As hydrophilic monomers that can be contained in a silicone hydrogel, well known items can be used without particular limitations, but as specific examples, we can list, for example, unsaturated carboxylic acids such as methacrylic acid, acrylic acid and the like, acrylic substituted alcohols such as 2-hydroxy ethyl methacrylate, 2-hydroxy ethyl acrylate and the like, vinyl lactam such as N-vinyl pyrrolidone and the like, and acryl amides such as methacryl amide, N, N-dimethylacryl amide and the like.

Also, when manufacturing the contact lens 12 using this kind of silicone hydrogel, as is described later, it is preferable to create a design that anticipates the change part of the dimension and shape that occurs along with high pressure steam sterilization processing in the storage solution 14 containing a phosphoric acid. By doing this, the values of each dimension such as the lens diameter (DIA) of the contact lens 12 at the time of shipping after the high pressure steam sterilization processing is in an optimal state, and a contact lens 12 for which that shipping time state is maintained is provided to the user.

As the contact lens package 10 that houses the contact lens 12, any of the well known contact lens packages can be used. The contact lens package 10, for example as shown in FIG. 1, has a constitution for which a film type package lid unit 15 is overlapped on the package main unit 11 made of synthetic resin, which is equipped with a roughly hemispherical shell shaped housing concave part 20, covering the housing concave part 20. The housing area 22 is formed by the housing concave part 20 of the package main unit 11, the contact lens 12 is housed in this housing area 22, and the storage solution 14 is also injected, so as to store the contact lens 12 in a state immersed in the storage solution 14.

Then, in a state with a specified volume of the storage solution 14 retained in the housing area 22 in which the contact lens 12 is housed, the package lid unit 15 is overlapped, and at the opening circumference edge part of the housing area 22, the package lid unit 15 is adhered so as to be able to be peeled off by gluing or welding it to the package main unit 11. Accordingly, the housing area 22 is hermetically sealed, and the contact lens 12 and the storage solution 14 are sealed therein. Preferably, as shown in FIG. 1, a plate shaped gripping plate part 26 that broadens outward in a flange shape from the opening circumference edge part of the housing concave part 20 is formed as a single unit on the package main unit 11. Then, a pinching part 28 is formed by having the end edge part of the package lid unit 15 laid so as to cover up to this gripping plate part 26 not be adhered with the gripping plate part 26 of the package main unit 11. By doing this, the user peels the package lid unit 15 from the package main unit 11 with the pinching part 28 as the starting point, making it easy to unseal the contact lens package 10.

Note that for the used package main unit 11, an item of a suitable shape and physical property is used according to the size and shape of the housed contact lens 12, the volume of the storage solution 14 and the like. Also, as the used package lid unit 15 as well, an item of a suitable structure and physical property is used according to the package main unit 11 physical properties, adhering means and the like. In specific terms, it is preferable to use an item consisting of synthetic resin material such as polypropylene or the like as the package main unit 11, and it is preferable to use an item consisting of a laminated film consisting of aluminum, polypropylene or the like as the package lid unit 15. Note that for the package main unit 11 and the package lid unit 15, both are items that can withstand the high pressure steam sterilization processing described later and are used according to the conditions thereof.

Also, with this embodiment, the storage solution 14 is constituted containing a phosphoric acid. In specific terms, the storage solution 14 preferably contains a phosphoric acid of 0.01 to 1.0 weight % in relation to the purified water as a solvent, and more preferably contains 0.2 to 0.4 weight %. It is likely that with the phosphoric-acid-concentration at less than 0.01 weight %, it would not be possible to sufficiently exhibit the target shape stability after the high pressure steam sterilization processing, and at greater than 1.0 weight %, there is the risk of an effect on the user's eyes when the contact lens is worn being a problem. Also, by having a phosphoric acid contained in the storage solution 14 in this way, after the high pressure steam sterilization processing described later, it is possible to prevent shape change and dimension change of the contact lens 12, and to improve the stability of the contact lens 12.

Note that more specifically, the phosphoric acid can be added to the storage solution 14 in a form such as phosphoric acid, sodium dihydrogen phosphate, sodium dihydrogen phosphate.dihydrate, sodium hydrogen phosphate, disodium hydrogen phosphate.12 hydrate, trisodium phosphate, trisodium phosphate.12 hydrate, tetrasodium pyrophosphate, tetrasodium pyrophosphate.10 hydrate, disodium dihydrogen pyrophosphate, dipotassium phosphate.trihydrate, potassium dihydrogen phosphate, dipotassium phosphate, tripotassium phosphate, potassium pyrophosphate, monocalcium phosphate.hydrate, dicalcium phosphate.dihydrate or the like. Note that the preferable numerical values for the phosphoric-acid-concentration described above indicate a weight % concentration with the hydration water of these substances removed. Specifically, as a method of calculating the preferable phosphoric-acid-concentration contained in the storage solution 14 with this embodiment, of the weight of these substances that are mixed in the storage solution 14, the net concentration of compound contained in each substance is preferably 0.01 to 1.0 weight %, and is more preferably 0.2 to 0.4 weight %.

Note that for the water as the solvent of the storage solution 14, in addition to pure water, it is also possible to use purified water, distilled water, filtrated water or the like.

Also, as substances other than phosphoric acid added to the storage solution 14, as long as there is no loss of the shape stabilization effect by the phosphoric acid after the high pressure steam sterilization processing, it is possible to use any well known formulation used for contact lens storage solution. In specific terms, it is possible to mix any of a chelating agent, isotonizing agent, pH adjuster, buffer agent, surfactant, thickening agent, preservative (preserving agent), wetting agent or the like to the storage solution 14. For these additives, it is possible to use only one type of substance each, or to use a combination of two or more.

Note that the phosphoric acid required for the present invention and the substance containing the phosphoric acid can have effects in addition to the shape stabilization effect after the high pressure steam sterilization processing that is an object of the present invention, for example such as a pH adjuster, buffer agent or the like. Because of that, it is possible to constitute the pH adjuster, buffer agent or the like of the storage solution 14 just with the phosphoric acid and substance containing the phosphoric acid, or it is also possible to combine and add with another pH adjuster, buffer agent or the like.

As the chelating agent, examples include ethylene diamine tetraacetic acid (EDTA) and hydrates thereof, ethylene diamine tetraacetic acid.disodium (EDTA.2Na) and hydrates thereof, ethylene diamine tetraacetic acid.trisodium (EDTA.3Na) and hydrates thereof, ethylene diamine tetraacetie acid.tetrasodium (EDTA.4Na) and hydrates thereof, phytic acid, citric acid, and the like.

As the isotonizing agent, examples include glycerin, propylene glycol, sodium chloride, potassium chloride, sorbitol, mannitol and the like.

As the pH adjuster, examples include hydrochloric acid, citric acid, acetic acid, sodium hydroxide, potassium hydroxide, sodium carbonate, sodium bicarbonate, and the like.

As the buffer agent, examples include boric acid, borax and borate buffer agent, carbonate buffer agent, acetic acid, citric acid, ϵ-amino caproic acid, 2-amino-2-methyl-1,3-propane (AMP) buffer agent, tris(hydroxymethyl)aminomethane(tris) buffer solution, bis (2-hydroxyethyl) amino tris(hydroxymethyl)methane(bis-tris) and the like.

As the surfactant, examples include polyglyceryl fatty acid ester, polyoxyethylene alkyl ether, polyoxyethylene.polyoxypropylene block copolymer, polyoxyethylene.polyoxypropylene ethylenediamine, polyoxyethylene sorbitan fatty acid ester, polyoxyethylene alkyl phenyl ether formaldehyde condensate, polyoxyethylene hydrogenated castor oil, polyoxyethylene alkyl phenyl ether, polyoxyethylene glycerin fatty acid ester, polyoxyethylene sorbit fatty acid ester, polyoxyethylene castor oil, polyoxyethylene sterol, polyoxyethylene hydrogenated sterol, polyoxyethylene fatty acid ester, polyoxyethylene.polyoxypropylene alkyl ether, polyoxyethylene lanolin alcohol, polyoxyethylene alkyl amine, polyoxyethylene alkylamide, polyoxyethylene alkyl ether phosphate, polysorbate, and the like.

As the thickening agent, examples include polyvinyl alcohol, polyvinyl pyrrolidone, polyethylene glycol, polypropylene glycol, polyacrylamide, and the like, cellulose derivatives such as hydroxypropyl methyl cellulose, hydroxypropyl cellulose or the like, starch derivatives, synthetic organic polymer compounds or the like.

As the preservative (preserving agent), examples include sorbic acid, potassium sorbate, benzalkonium chloride, benzethonium chloride, methyl parahydroxybenzoate, propyl parahydroxy-benzoate, chlorobutanol or the like.

As the wetting agent, examples include glycerin, polyethylene glycol, propylene glycol, polyvinyl alcohol, polyvinyl pyrrolidone, cationic cellulose polymer, hydroxypropyl methyl cellulose, hydroxyethyl cellulose, methyl cellulose or the like.

The pH of the storage solution 14 is preferably adjusted to within a range of pH 6.0 to 8.0, and more preferably adjusted to within a range of pH 7.2 to 8.0. If the pH is in this kind of preferable range, it is possible to prevent degradation of the silicone hydrogel by the high pressure steam sterilization processing, and to sufficiently maintain the strength of the contact lens. Meanwhile, if the pH goes below 6.0, or if it goes above 8.0, there is concern that there will be an effect on the user's eye when the contact lens 12 is used, and also, concern about an effect on the physical properties and the like of the contact lens 12. Note that the pH of the storage solution 14 is preferably kept in this kind of suitable range by the action of the phosphoric acid and other buffer agents even after the high pressure steam sterilization processing described later. By doing this, the contact lens 12 shape stabilization action after high pressure steam sterilization processing in the presence of a phosphoric acid is effectively achieved.

The storage solution 14 osmotic pressure is adjusted to be within a range of 175 to 455 mOsm, and preferably adjusted so that the osmotic pressure ratio to normal saline is approximately 0.60 to 1.55. If the osmotic pressure exceeds this kind of range, there is the risk that irritation or the like may occur in the eye of the user, or trouble may occur such as deformation of the contact lens 12 or the like.

It is preferable that 0.15 to 4 mL of the storage solution 14 be sealed inside the housing area 22 of the contact lens package 10. With this arrangement, it is possible to effectively achieve the stabilization effect of the phosphoric acid with the high pressure steam sterilization processing described later and the storage period that follows it.

Manufacturing of the contact lens package 10 is performed with the following kind of process. First, as shown in FIG. 1, a specified volume of the storage solution 14 and the contact lens 12 are housed in the housing area 22 of the package main unit 11. Then, by the package lid unit 15 being sealed on the opening part of the housing area 22, the package main unit 11 is hermetically sealed, and the contact lens package 10 is produced. Specifically, the contact lens 12 is sealed in the housing area 22 of the contact lens package 10 in a state immersed in the storage solution 14 containing a phosphoric acid.

Also, high pressure steam sterilization processing is implemented on the contact lens package 10. For the specific conditions for the high pressure steam sterilization processing, there is no specific limitation as long as it is in a range for which the contact lens package 10 is sufficiently sterilized, and there is no undesirable effect given to the physical properties of the contact lens package 10, the contact lens 12, and the storage solution 14 and the like, or to the shape stabilization effect of the phosphoric acid, but preferably the conditions are 15 to 60 minutes at 115 to 130° C, and pressure of 2.0 to 2.8.

Then, with this embodiment, during the high pressure steam sterilization processing, by the storage solution 14 in which the contact lens 12 consisting of silicone hydrogel is immersed containing a phosphoric acid, it is possible to suppress changes in the shape of the contact lens 12 after the high pressure steam sterilization processing. It is not yet clear why this kind of effect appears, but one assumption is that the shape change (diameter expansion or the like) of the contact lens 12 consisting of silicone hydrogel that normally progresses significantly with the passage of time progresses all at once in a short time due to the high pressure steam sterilization processing in the presence of the phosphoric acid, and as a result, it is thought that the shape change after the high pressure steam sterilization processing doesn't proceed beyond that.

Note that with this kind of high pressure steam sterilization processing in the presence of a phosphoric acid, we know that a roughly fixed shape change occurs to the contact lens 12 such as an increase in the roughly fixed width lens diameter (DIA) or the like. Because of that, for the design of the contact lens 12, it is preferable to anticipate in advance the shape changes such as diameter expansion or the like due to the high pressure steam sterilization processing in the presence of a phosphoric acid. By designing each dimension assuming the state with the completion of the shape change due to the high pressure steam sterilization processing, the contact lens 12 with the initial dimensions after high pressure steam sterilization processing will be completed and shipped. Then, if this embodiment is followed, even after shipping, the contact lens 12 is maintained in a state with this shape at the time of shipping kept very well for a long time.

When the high pressure steam sterilization processing ends, the completed contact lens packages 10 are shipped to the market kept in a hermetically sealed state, and are provided to users via stores or the like.

Here, with this embodiment, by the contact lens 12 sealed in the contact lens package 10 immersed in the storage solution 14 containing a phosphoric acid undergoing the high pressure steam sterilization processing, it is possible to suppress the shape change of the contact lens 12 over a long time until it is used by the user, and possible to maintain the shape at the time of shipping well. Note that the time until the contact lens package 10 is provided to the user after being manufactured and actually used in some cases takes from several months to several years or more. However, if this embodiment is followed, even in a case when the storage period is from several months to several years or more, it is possible to suppress the shape change and dimension change of the contact lens 12, and to maintain the shape at the time of shipping, so the user is able to wear the contact lens 12 in a good state based on the intended design of the manufacturers.

Specifically, with a contact lens package manufactured using the prior art, it was discovered through the research of the inventors that it is difficult to sufficiently ensure the lens dimension precision due to shape change occurring after manufacturing for the contact lens which is a soft contact lens consisting of silicone hydrogel. More specifically, for example it was found that there is a gradual increase (diameter expansion) of the lens diameter (DIA) along with the passage of time after manufacturing, and this kind of DIA increase was found to have a risk of causing problems such as a decrease in the wearing comfort or the like.

However, with the contact lens package 10 manufactured according to this embodiment, it is possible to effectively suppress shape changes of the contact lens 12 over a long time, and it is possible to store the contact lens 12 in a state with the manufacturing standards such as DIA or the like sufficiently maintained. In specific terms, for example, the range of fluctuation of the DIA even when 15 months have elapsed since storage start can be suppressed to only approximately ±0.05 mm. Also, as a result of effectively suppressing the shape change (dimension change) of the lens in this way, it is possible to prevent a decrease in the wearing comfort or a decrease in the visual acuity adjustment capacity due to a skew in the power that comes with an increase in the DIA of the contact lens 12.

In fact, this kind of shape stabilization effect is also brought by the very highly safe physical properties of phosphoric acid in relation to the human body, so an effect on the eyes during use of the contact lens 12 is prevented.

Also, if the method described above is followed, it is also possible to stabilize the shape, etc. of not just the contact lens 12 consisting of silicone hydrogel, but also other molded products consisting of silicone hydrogel or molded products constituted containing silicone hydrogel or the like. Specifically, as an embodiment of the present invention relating to a method of stabilizing a silicone hydrogel molded product, instead of the contact lens 12 with the embodiment of the present invention relating to the manufacturing method of a contact lens package described above, as a silicone hydrogel molded product, for example an intraocular lens, artificial cartilage, catheter or the like manufactured using silicone hydrogel is immersed in the same storage solution 14 containing a phosphoric acid as the embodiment described above, this is hermetically sealed in a package (not illustrated), and by implementing high pressure steam sterilization processing with the same conditions as the embodiment described above, it is possible to stabilize the silicone hydrogel. Specifically, if this embodiment is followed, it is possible to prevent shape change or dimension change as well as degradation of strength or the like for silicone hydrogel sealed in a package for a long time, so it is possible to stably store silicone hydrogel molded products. Note that the specific composition of the storage solution 14 is not particularly limited as long as there is no loss of the phosphoric acid stabilization effect, and can be suitably matched and changed with the physical properties, the use or the like of the molded product that is to be stabilized.

While the present invention has been described in detail while illustrating specific examples of preferred embodiments of the present invention, but these are only examples, and the present invention is not to be interpreted as being limited in any way by the specific notations described above.

EXAMPLES

Following, we will show the results of tests performed to further clarify the technical significance of the present invention relating to the manufacturing method of a contact lens package and the contact lens package.

First, using a storage solution containing a phosphoric acid and a storage solution that does not contain a phosphoric acid, storage tests of soft contact lenses made of silicone hydrogel, and contact lenses made of hydrogel were performed. The results are shown hereinbelow.

With this test, testing was performed on three groups with different conditions, Group A, Group B, and Group C. Specifically, these are Group A (comparison example 1) using storage solution A that does not contain a phosphoric acid and contact lenses made of silicone hydrogel, Group B (embodiment 1) using storage solution B that does contain a phosphoric acid and contact lenses made of silicone hydrogel, and Group C (comparison example 2) using storage solution A that does not contain a phosphoric acid and contact lenses made of hydrogel. Also, with each of Group A, Group B, and Group C, lenses of 2 or more standards with different powers were prepared, and 6 each of each standard or 15 each were tested. Table 1 below shows the details of the respective contact lenses of Group A, Group B, and Group C, and the storage solutions that were used together. Note that for the table 1 lens standards, BC means base curve, P means power, and DIA means the lens diameter. Also, the BC and DIA unit is mm, and the P unit is diopters (D).

TABLE 1

| | Group A (Comparison example 1) | Group B (Embodiment 1) | Group C (Comparison example 2) |
|---|---|---|---|
| Lens type | Silicone hydrogel | Silicone hydrogel | Hydrogel |
| Lens material | Asmofilcon A | Asmofilcon A | Govafilcon A |
| Lens | 8.70/−3.00/14.0 | 8.60/−3.00/14.0 | 8.70/−7.00/13.5 |

TABLE 1-continued

| | Group A (Comparison example 1) | Group B (Embodiment 1) | Group C (Comparison example 2) |
|---|---|---|---|
| standard and count (BC/P/DIA count) | 6 lenses 8.70/−7.00/14.0 6 lenses | 6 lenses 8.60/−8.00/14.0 6 lenses 8.60/+6.00/14.0 6 lenses | 15 lenses 8.70/−2.00/13.5 15 lenses 8.70/+3.00/13.5 15 lenses |
| Storage solution | Storage solution A (without phosphoric acid) | Storage solution B (with phosphoric acid) | Storage solution A (without phosphoric acid) |

Table 2 below shows the details of the used storage solutions. Specifically, the used storage solutions are the two type including storage solution A which does not contain a phosphoric acid, and storage solution B which does contain a phosphoric acid, and with storage solution B, 0.6 weight % disodium hydrogen phosphate.12 hydrate and 0.04 weight % sodium dihydrogen phosphate.dihydrate are blended. As a result, when the hydration water weight is removed, the storage solution B contains a phosphoric-acid-component of 0.27 weight % of the total.

TABLE 2

| | | Storage solution A | Storage solution B |
|---|---|---|---|
| Composition (Unit: Weight %) | Sodium chloride | 0.9 | 0.8 |
| | Sodium hydrogen phosphate • 12 hydrate $Na_2HPO_4 \cdot 12H_2O$ | — | 0.6 |
| | Sodium dihydrogen phosphate • dihydrate $NaH_2PO_4 \cdot 2H_2O$ | — | 0.04 |
| | Purified water | Residual part | Residual part |
| | pH | Approximately 7 | Approximately 7 |

Using the aforementioned contact lens and storage solution, storage tests were performed using the following procedure. First, the necessary number of each of the contact lenses were prepared in a dry state, and these were immersed for 12 hours or more in each storage solution and hydrated. Next, after sealing each contact lens together with 4 mL of a storage solution in a vial, high pressure steam sterilization processing was implemented for 20 minutes at 120° C. using a high pressure steam sterilization machine (Sanyo Electric MLS-3020). The vials after this high pressure steam sterilization processing were stored respectively for 9 to 24 months at 45° C. for Group A and Group B, and at 40° C. for Group C.

Then, at each time point after the high pressure steam sterilization processing, the contact lens and storage solution were adjusted to a state of 20° C., and the contact lens diameter was measured using a 10× magnification projector (Nikon, V12A). Note that the measurement method of this diameter was the typical measurement method based on the method noted in "ISO18369-3(2006): Ophthalmic optics-Contact lenses Part 3: Measurement methods, 4 Methods of measurement for contact lens, 4.3 Diameters and widths."

Figure 2:
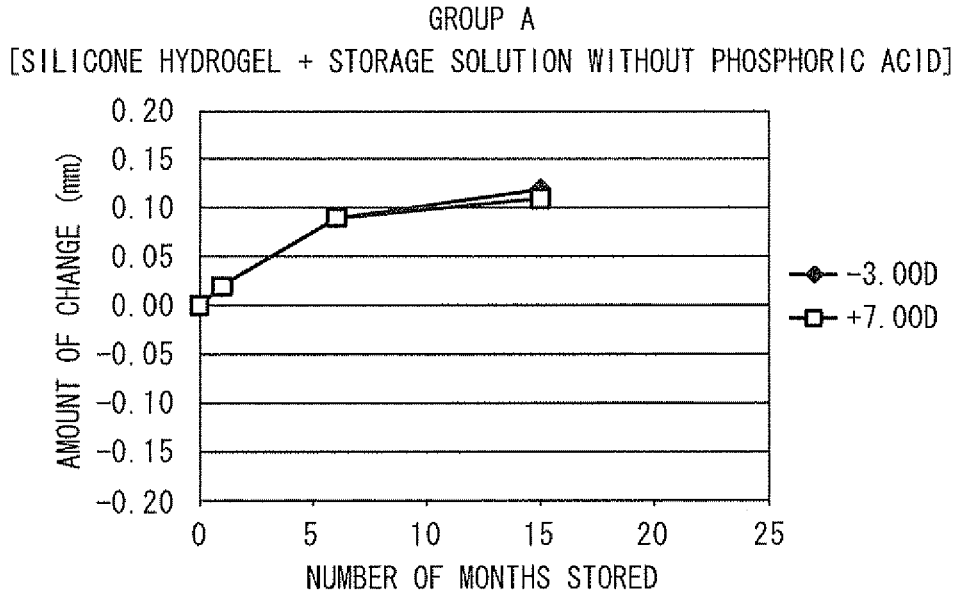
FIG. 2 is a graph showing the storage results of a comparison example with respect to an embodiment of the present invention relating to the manufacturing method of a contact lens package.
Figure 3:
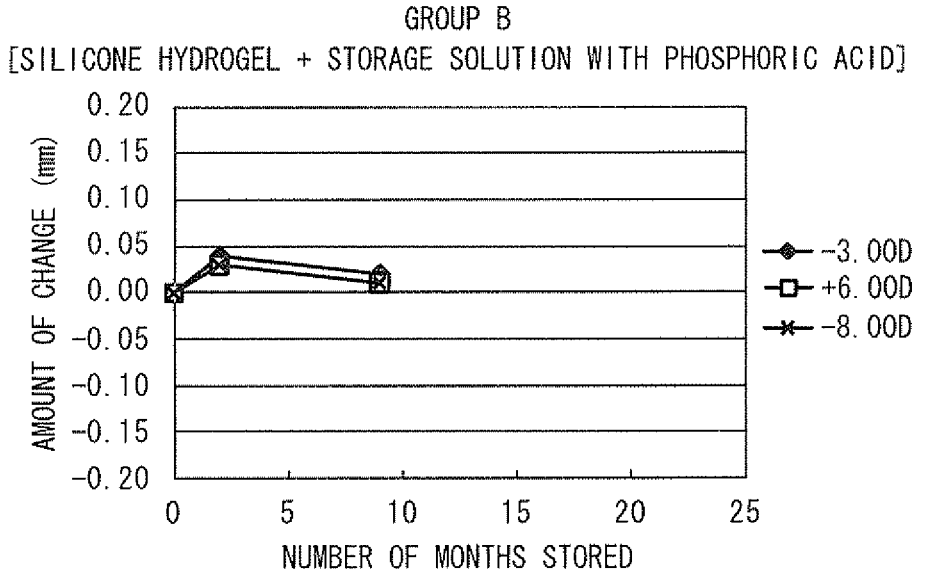
FIG. 3 is a graph showing the storage results of an example of an embodiment of the present invention relating to the manufacturing method of a contact lens package.
Figure 4:
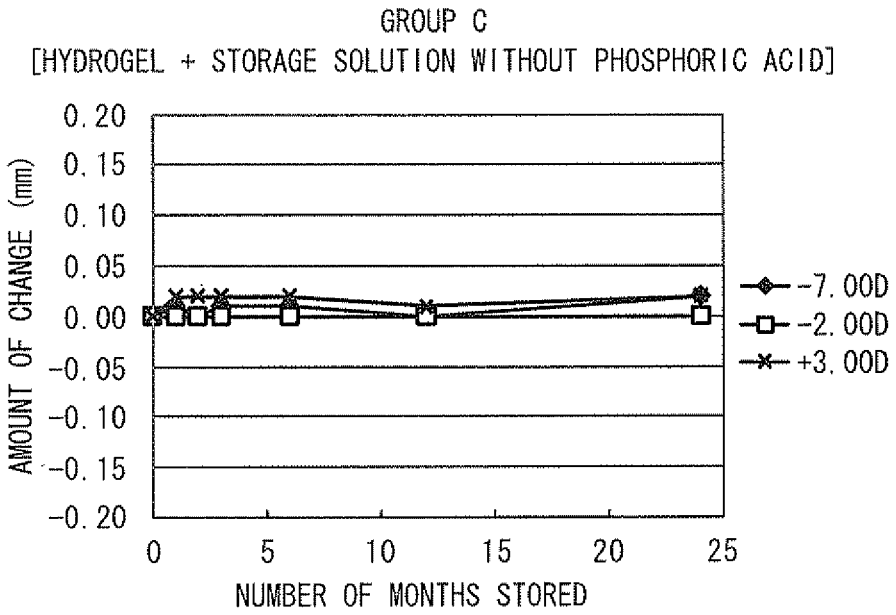
FIG. 4 is a graph showing the storage results of another comparison example with respect to the embodiment of the present invention relating to the manufacturing method of a contact lens package.

The respective lens diameter values for Group A, Group B, and Group C measured using the method noted above are shown in tables 3 to 5 below. Also, the graphs in FIGS. 2 to 4 show the status of the changes from the initial value after the high pressure steam sterilization processing. Note that the numerical values of each table and graph are average values of 6 or 15 items per lens power (P).

TABLE 3

Unit: mm

| P | Number of months stored at 45° C. 0 months | 1 month | 6 months | 15 months |
|---|---|---|---|---|
| Actual measured value | | | | |
| −3.00 D | 13.93 | 13.95 | 14.02 | 14.05 |
| +7.00 D | 13.95 | 13.97 | 14.04 | 14.06 |
| Difference from start | | | | |
| −3.0 D | 0 | 0.02 | 0.09 | 0.12 |
| +7.0 D | 0 | 0.02 | 0.09 | 0.11 |

TABLE 4

Unit: mm

| P | Number of months stored at 45° C. 0 months | 2 months | 9 months |
|---|---|---|---|
| Actual measured value | | | |
| −3.00 D | 14.09 | 14.13 | 14.11 |
| +6.00 D | 14.1 | 14.13 | 14.11 |
| −8.00 D | 14.11 | 14.14 | 14.12 |
| Difference from start | | | |
| −3.0 D | 0 | 0.04 | 0.02 |
| +6.0 D | 0 | 0.03 | 0.01 |
| −8.0 D | 0 | 0.03 | 0.01 |

TABLE 5

Unit: mm

| P | Number of months stored at 40° C. 0 months | 1 month | 2 months | 3 months | 6 months | 12 months | 24 months |
|---|---|---|---|---|---|---|---|
| Actual measured value | | | | | | | |
| −7.00 D | 13.63 | 13.64 | 13.63 | 13.64 | 13.64 | 13.63 | 13.65 |
| −2.00 D | 13.62 | 13.62 | 13.62 | 13.62 | 13.62 | 13.62 | 13.62 |
| +3.00 D | 13.63 | 13.65 | 13.65 | 13.65 | 13.65 | 13.64 | 13.65 |
| Difference from start | | | | | | | |
| −7.00 D | 0 | 0.01 | 0 | 0.01 | 0.01 | 0 | 0.02 |
| −2.00 D | 0 | 0 | 0 | 0 | 0 | 0 | 0 |
| +3.00 D | 0 | 0.02 | 0.02 | 0.02 | 0.02 | 0.01 | 0.02 |

As is clear from the results in FIG. 2 and table. 3, with Group A (comparison example 1) which uses storage solution A which does not contain a phosphoric acid, during the storage period, the lens diameter increases with the passage of time. This kind of lens diameter expansion is similarly seen with all of the lens standards of power (P) plus (+7.00 D) and minus (−3.00 D), and at 15 months after high pressure steam sterilization processing, they were respectively increased in lens diameter by approximately 0.12 mm each.

Meanwhile, as is clear from the results shown in FIG. 3 and table. 4 below, with Group B (embodiment 1) using the storage solution B which does contain a phosphoric acid, almost no increase in lens diameter was seen even when 9 months elapsed after high pressure steam sterilization processing. This kind of shape stability was similarly seen with all of the lens standards of power (P) plus (+6.00 D), minus (−3.00 D, −8.00 D), and for all of these, the lens diameter had only fluctuated by a maximum of about 0.04 mm even at 9 months after high pressure steam sterilization processing.

Note that as is clear from the results shown as reference in FIG. 4 and table. 5, with Group C (comparison example 2) using hydrogel contact lenses, even with storage solution A which does not contain a phosphoric acid, almost no increase in lens diameter occurred during the storage period. This is because the stability of soft contact lenses constituted using hydrogel is higher from the start than that of silicone hydrogel soft contact lenses. When these results are compared with the results of Group A using silicone hydrogel contact lenses, we can easily understand that the problem of shape changing such as lens diameter expansion during long storage periods is a phenomenon specific to silicone hydrogel.

As described above, when the Group A, Group B, and Group C results are compared, we can see that the specific phenomenon of shape change such as an increase in lens diameter (DIA) which is a problem with silicone hydrogel soft contact lenses which have lower stability than normal hydrogel soft contact lenses can be effectively suppressed by performing high pressure steam sterilization processing using a storage solution containing a phosphoric acid according to this embodiment.

Note that with contact lens product standards, the allowed range of deviation from the standard values (with this embodiment, all 14.00 mm) for lens diameter (DIA) is only ±0.20 mm. With Group A using storage solution A which does not contain a phosphoric acid, an increase of a maximum of 0.12 mm from the initial value had occurred at 15 months, and with long term storage, we can see that it is difficult to maintain the product standards. Meanwhile, with Group B using storage solution B which does contain a phosphoric acid, the fluctuation range from the initial value stops at a maximum of about ±0.04 mm, and we can see that it is possible to satisfy the product standards at a high level.

Note that with the tests described above, contact lenses based on prior art dimension designs were used, but for conformity with this kind of product standard, it is preferable to anticipate in advance at the time of lens design the shape changes and dimension changes that occur with high pressure steam sterilization processing in a storage solution containing a phosphoric acid. In this way, by designing so that the contact lenses have the optimal shape (dimension) in the state when high pressure steam sterilization processing is completed, it is clear that the lens shape will be shipped in the optimal state, and that it is possible to maintain the contact lenses in the initial shape over a long time after that.

Next, as reference, we will show the results of tests for checking the shape changes (dimension changes) at the time of high pressure steam sterilization processing in this kind of storage solution that contains a phosphoric acid.

With this experiment, changes in the lens diameter (DIA) before and after high pressure steam sterilization processing were checked. Note that for the contact lenses, of the lenses shown in table 1 used with Group B noted above, lenses of two standard types, power (P) −3.00 D and −8.00 D, 5 items each, were used. The composition of the used storage solution B is the same as that shown in table 2 used with the tests described above.

For a total of 10 of these contact lenses, using the same method as the previous storage test, the lens diameters were measured before high pressure steam sterilization processing and after high pressure steam sterilization processing.

Figure 5A:
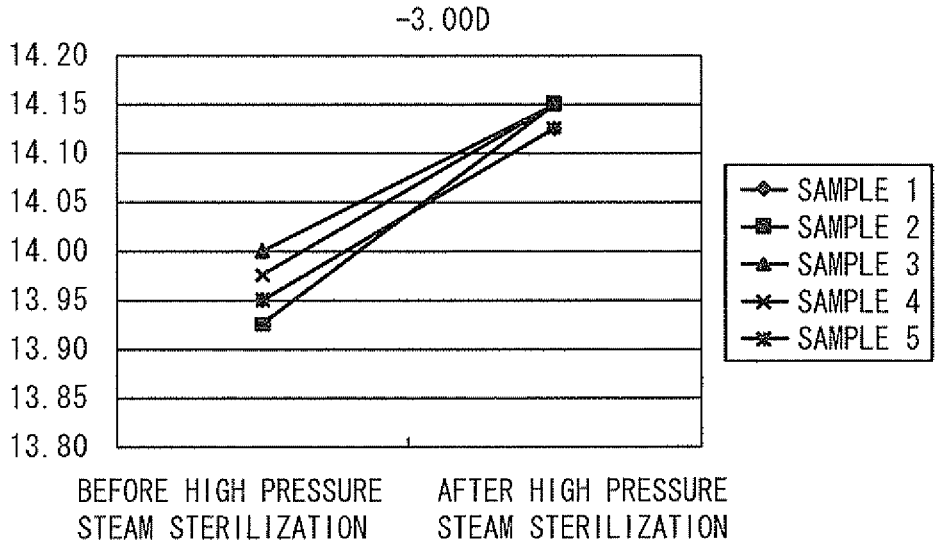
FIGS. 5A and 5B are graphs showing the effect of high pressure steam sterilization processing for one embodiment of the present invention relating to the manufacturing method of a contact lens package.
Figure 5B:
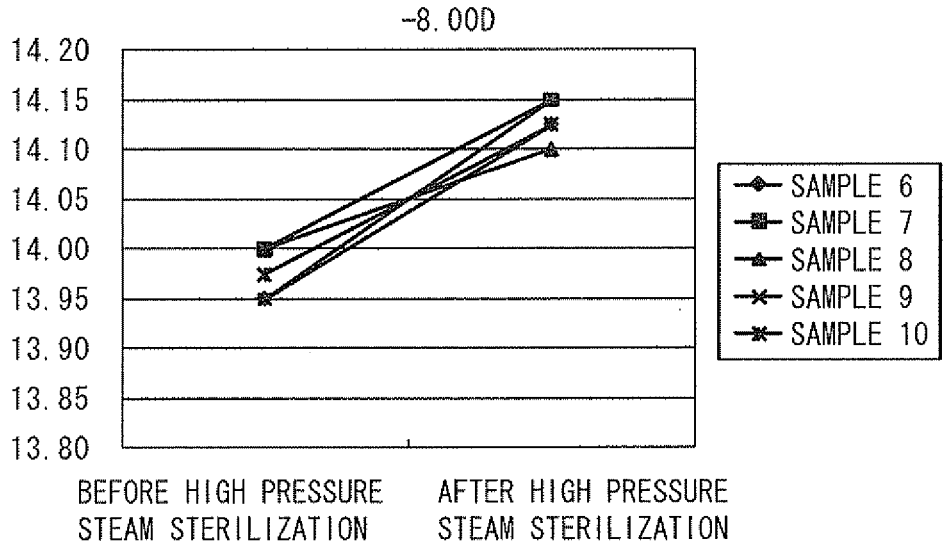

The lens diameter measurement results are shown in table 6 and the graphs of FIGS. 5A and 5B below. Also, the standard values in terms of lens diameter (DIA) product standards for the two types of contact lenses used are 14.00 mm for lenses of both powers −3.00 D and −8.00 D as shown in table 2 noted above.

TABLE 6

| Actual measured value | | | |
|---|---|---|---|
| | | | Unit: mm |
| P | Sample | Before high pressure steam sterilization processing | After high pressure steam sterilization processing |
| −3.00 D | 1 | 13.95 | 14.13 |
| | 2 | 13.93 | 14.15 |
| | 3 | 14.00 | 14.15 |
| | 4 | 13.98 | 14.15 |
| | 5 | 13.95 | 14.13 |
| −8.00 D | 1 | 13.95 | 14.13 |
| | 2 | 14.00 | 14.15 |
| | 3 | 14.00 | 14.10 |
| | 4 | 13.95 | 14.15 |
| | 5 | 13.98 | 14.13 |
| Average | | 13.97 | 14.14 |
| Standard deviation | | 0.0265 | 0.017 |

As is also clear from the results shown in table 6 and FIG. 5, with contact lenses of both standards of power −3.00 D and −8.00 D, we can see that the lens diameter increases by approximately 0.18 mm roughly uniformly.

In this way, by performing high pressure steam sterilization processing on silicone hydrogel soft contact lenses in a state hermetically sealed together with a storage solution containing a phosphoric acid according to this embodiment, roughly constant shape changes occur to the contact lenses within a short time. Also, as became clear with the storage tests described above, if this embodiment is followed, after high pressure steam sterilization processing, the lens shape immediately after the high pressure steam sterilization processing can be kept well over a long period of several months or more.

Also, at the time before the high pressure steam sterilization processing, a slight deviation of the lens diameter of each lens occurred, but the range of that variation was comparatively small at about 0.05 to 0.07 mm. Note that this kind of variation before the high pressure steam sterilization processing is thought to be due to tiny dimensional differences that occur during molding of the contact lenses. Meanwhile, according to the results with the storage test (Group A) using the storage solution that does not contain a phosphoric acid described previously, the change in lens diameter that occurs over 15 months is approximately 0.12 mm. Specifically, according to these test results, we can see that the problem of dimensional changes to silicone hydrogel contact lenses that occurs after shipping has an even greater effect than the variation in dimensions that occurs at the time of molding of the contact lenses. Also, if this embodiment is followed, it is possible to very effectively resolve this kind of big problem of dimensional changes in contact lenses during long term storage by performing high pressure steam sterilization processing using a storage solution containing a phosphoric acid.

Furthermore, strength measurement testing was performed to confirm the strength of silicone hydrogel soft contact lenses after high pressure steam sterilization processing using this kind of storage solution containing a phosphoric acid according to this embodiment.

Specifically, with this test, high pressure steam sterilization processing was implemented respectively on silicone hydrogel soft contact lenses using storage solution A which does not contain a phosphoric acid and storage solution B which does contain a phosphoric acid shown in table 2, the same as with the storage test described above. Also, the used silicone hydrogel contact lenses were Asmofilcon A shown in table 1, and 20 each of these were used with storage solutions A and B. Note that the conditions for the high pressure steam sterilization processing are the same as for each of the tests described above. Note that the pH for storage solution A was 7.0, and the pH for storage solution B was 7.5.

Then, the Young's modulus of each contact lens after high pressure steam sterilization processing was measured, and strength was checked. The measurement method is the typical measurement method according to JIS K7113-1995 and JIS K7127-1999 (Part 3). In specific terms, first, a sample piece in a dumbbell shape was produced from each contact lens after the high pressure steam sterilization processing, with reference to the aforementioned JIS standard. Status adjustment was done using a constant temperature water bath the same as when doing the lens diameter measurement for each of the tests described above, and in a normal saline solution at 20° C., the sample piece was stretched using a universal testing instrument (Instron Japan Co., Ltd., 4301), and the Young's modulus was measured.

As a result, the Young's modulus when using the pH 7.0 storage solution A that does not contain a phosphoric acid was 1.05 MPa (S. D.=0.17, n=15). Meanwhile, the Young's modulus when using the pH 7.5 storage solution B which does contain a phosphoric acid was 1.02 MPa (S. D.=0.09, n=18).

Therefore, even when using the storage solution set at pH 7.5 according to this embodiment, we can see that an increase in the Young's modulus due to degradation of silicone hydrogel did not occur. Thus, according to this embodiment, even when the pH value is relatively high at 7.2 or greater, the Young's modulus did not increase even after high pressure steam sterilization processing, and the physical properties of the silicone hydrogel were kept well. In this way, if this embodiment is followed, it is possible to prevent dimension changes to silicone hydrogel, and it is also possible to suppress degradation of physical properties such as a decrease in strength well, making it possible to stably store contact lenses consisting of silicone hydrogel.

KEYS TO SYMBOLS

10: Contact lens package, 11: Package main unit, 12: Contact lens, 14: Storage solution, 22: Housing area

The invention claimed is:

1. A manufacturing method of a contact lens package in which a soft contact lens and a storage solution are hermetically sealed in a housing area, comprising:

preparing a silicone hydrogel contact lens as the soft contact lens, wherein a diameter of the prepared silicone hydrogel contact lens is smaller, by a predetermined amount, than an intended diameter of the silicone hydrogel contact lens after a high pressure steam sterilization processing in a presence of a phosphoric acid;

preparing the storage solution so as to contain the phosphoric acid;

sealing the silicone hydrogel contact lens together with the storage solution containing the phosphoric acid in the housing area; and then performing the high pressure steam sterilization processing, thereby increasing the diameter of the silicone hydrogel contact lens to the intended diameter.

2. The manufacturing method of a contact lens package according to claim 1, wherein a phosphoric-acid-concentration in the storage solution is 0.01 to 1.0 weight %.

3. The manufacturing method of a contact lens package according to claim 1, wherein a pH of the storage solution is 7.2 to 8.

4. The manufacturing method of a contact lens package according to claim 1, wherein the diameter of the prepared silicone hydrogel contact lens is 0.7-1.6% smaller than the intended diameter.

5. A method of stabilizing a silicone hydrogel contact lens hermetically sealed together with a storage solution inside a contact lens package, comprising:

preparing the silicone hydrogel contact lens with a diameter that is smaller, by a predetermined amount, than an intended diameter of the silicone hydrogel contact lens after a high pressure steam sterilization processing in a presence of a phosphoric acid;

preparing the storage solution so as to contain the phosphoric acid;

sealing the silicone hydrogel contact lens together with the storage solution containing the phosphoric acid inside the contact lens package; and then performing the high pressure steam sterilization processing, thereby increasing the diameter of the silicone hydrogel contact lens to the intended diameter.

6. The method of stabilizing a silicone hydrogel contact lens according to claim 5, wherein the diameter of the prepared silicone hydrogel contact lens is 0.7-1.6% smaller than the intended diameter.

* * * * *